US011574762B2

(12) United States Patent
Li et al.

(10) Patent No.: US 11,574,762 B2
(45) Date of Patent: Feb. 7, 2023

(54) COIL COMPONENT WITH TURNS HAVING DIFFERENCES IN HEIGHTS AT CORNER PORTIONS

(71) Applicant: SAMSUNG ELECTRO-MECHANICS CO., LTD., Suwon-si (KR)

(72) Inventors: Yong Hui Li, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 367 days.

(21) Appl. No.: 16/879,011

(22) Filed: May 20, 2020

(65) Prior Publication Data

US 2021/0142939 A1 May 13, 2021

(30) Foreign Application Priority Data

Nov. 7, 2019 (KR) ..... 10-2019-0141730

(51) Int. Cl.
*H01F 17/00* (2006.01)
*H01F 27/32* (2006.01)
(Continued)

(52) U.S. Cl.
CPC ..... *H01F 17/0033* (2013.01); *H01F 17/0013* (2013.01); *H01F 27/006* (2013.01);
(Continued)

(58) Field of Classification Search
CPC ..... H01F 17/0006; H01F 17/0013; H01F 17/0033; H01F 2017/002; H01F 2017/004;
(Continued)

(56) References Cited

U.S. PATENT DOCUMENTS

2009/0322458 A1 12/2009 Lee et al.
2011/0291785 A1 12/2011 Lim et al.
(Continued)

FOREIGN PATENT DOCUMENTS

CN 107799268 A 3/2018
JP 2010-016337 A 1/2010
(Continued)

OTHER PUBLICATIONS

Orean Office Action dated Sep. 8, 2020 issued in Korean Patent Application No. 10-2019-0141730 (with English translation).
(Continued)

*Primary Examiner* — Younes Boulghassoul
(74) *Attorney, Agent, or Firm* — Morgan, Lewis & Bockius LLP

(57) ABSTRACT

A coil component includes a body and a coil portion embedded in the body and having a plurality of turns wound about an axis. Each of the plurality of turns includes a plurality of corner portions adjacent to corners of the body, and at least one connection portion connecting adjacent corner portions among the plurality of corner portions, and a difference in heights, measured in the direction of the axis, between an innermost turn and a turn adjacent to the innermost turn, among the plurality of turns, is greater in the corner portion than in the connection portion.

22 Claims, 10 Drawing Sheets

(51) Int. Cl.
*H01F 27/00* (2006.01)
*H01F 27/28* (2006.01)

(52) U.S. Cl.
CPC ..... *H01F 27/323* (2013.01); *H01F 2017/002* (2013.01); *H01F 2017/0073* (2013.01); *H01F 2027/2809* (2013.01)

(58) Field of Classification Search
CPC ..... H01F 2017/0053; H01F 2017/0066; H01F 2017/0073; H01F 2017/048; H01F 41/042; H01F 41/046; H01F 41/061; H01F 41/062; H01F 41/074; H01F 27/006; H01F 27/2804; H01F 2027/2809; H01F 41/041–043; H01F 41/063
See application file for complete search history.

(56) References Cited

U.S. PATENT DOCUMENTS

2015/0340149 A1* 11/2015 Lee ..... H01F 27/292 336/200
2016/0217907 A1* 7/2016 Jeong ..... H01F 17/0013
2016/0351320 A1* 12/2016 Jeong ..... H01F 27/292
2017/0032883 A1 2/2017 Hong et al.
2017/0178789 A1* 6/2017 Kim ..... H01F 27/324
2018/0033533 A1* 2/2018 Ryu ..... H01F 17/0013
2019/0074126 A1* 3/2019 Kim ..... H01F 27/292
2019/0088402 A1* 3/2019 Kim ..... H01F 27/324
2019/0103215 A1* 4/2019 Jung ..... H01F 5/003
2019/0198215 A1* 6/2019 Choi ..... H01F 17/0013
2019/0259522 A1* 8/2019 Kim ..... H01F 27/24
2019/0362886 A1* 11/2019 Bong ..... H01F 27/2804

FOREIGN PATENT DOCUMENTS

JP 2016-225463 A 12/2016
KR 10-1719914 B1 3/2017
KR 10-2019-0038015 A 4/2019
WO 97/24739 A1 7/1997

OTHER PUBLICATIONS

Chinese Office Action dated Apr. 6, 2022 , issued in corresponding Chinese Patent Application No. 202010667332.0.

* cited by examiner

A-A'

310
- 3111
- 3112
- 3113
- 3114
- 3121
- 3122
- 3123
- 3124

I - I '

II-II'

III-III'

B-B'

310
- 3111
- 3112
- 3113
- 3114
- 3121
- 3112
- 3123
- 3124

I - I'

II-II'

III-III'

COIL COMPONENT WITH TURNS HAVING DIFFERENCES IN HEIGHTS AT CORNER PORTIONS

CROSS-REFERENCE TO RELATED APPLICATION(S)

This application claims benefit of priority to Korean Patent Application No. 10-2019-0141730 filed on Nov. 7, 2019 in the Korean Intellectual Property Office, the disclosure of which is incorporated herein by reference in its entirety.

BACKGROUND

1. Field

The present disclosure relates to a coil component.

2. Description of Related Art

An inductor, a coil component, is a typical passive electronic component used in electronic devices, along with a resistor and a capacitor.

As electronic devices become increasingly high performing while being miniaturized, the number of coil components used in the electronic devices increases and the coil components become smaller.

Meanwhile, a power inductor may be designed such that magnetic flux is concentrated in a core portion, narrower than a cover portion, and in a portion in which the number of turns of a coil portion is greater around a through-via. In this case, the flow of magnetic flux can be optimized through structural improvements of the portion in which magnetic flux is concentrated, so as to further increase inductance capacity of a body in the same volume.

SUMMARY

An aspect of the present disclosure is to provide a coil component optimizing flow of magnetic flux to mitigate magnetic flux concentration.

Another aspect of the present disclosure is to provide a coil component having improved inductance capacity of a body in the same volume.

According to an aspect of the present disclosure, a coil component may include a body and a coil portion embedded in the body and having a plurality of turns wound about an axis. Each of the plurality of turns may include a plurality of corner portions adjacent to corners of the body, and at least one connection portion connecting adjacent corner portions among the plurality of corner portions, and a difference in heights, measured in the direction of the axis, between an innermost turn and a turn adjacent to the innermost turn, among the plurality of turns, is greater in the corner portion than in the connection portion.

According to another aspect of the present disclosure, a coil component may include a support substrate, a body embedding the support substrate, and a coil portion disposed on the support substrate and having a plurality of turns . The coil portion has a first region, and a second region having a curvature radius, greater than a curvature radius of the first region, and a difference in heights between an innermost turn and a turn adjacent to the innermost turn, among the plurality of turns, is greater in the first region than in the second region.

According to a further aspect of the present disclosure, a coil component may include a body and a coil portion embedded in the body and having a plurality of turns wound about an axis extending through a center of the coil. The body includes a first margin disposed between the coil portion and a first outer surface of the body, and a second margin disposed between the coil portion and a second outer surface of the body opposing the first outer surface in a width direction orthogonal to the axis. A number of turns of the coil portion between the center of the coil portion and the first margin portion is greater than a number of turns of the coil portion between the center of the coil portion and the second margin portion, and a width of the first margin portion in the width direction is greater than a width of the second margin portion in the width direction.

According to another aspect of the present disclosure, a coil component may include a body and a coil portion embedded in the body and having a plurality of turns wound about an axis. Each of the plurality of turns includes a plurality of corner portions adjacent to corners of the body, and at least one connection portion connecting adjacent corner portions among the plurality of corner portions, and a height, measured in the direction of the axis, of a turn among the plurality of turns is lower in each of the plurality of corner portions than in the connection portion.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
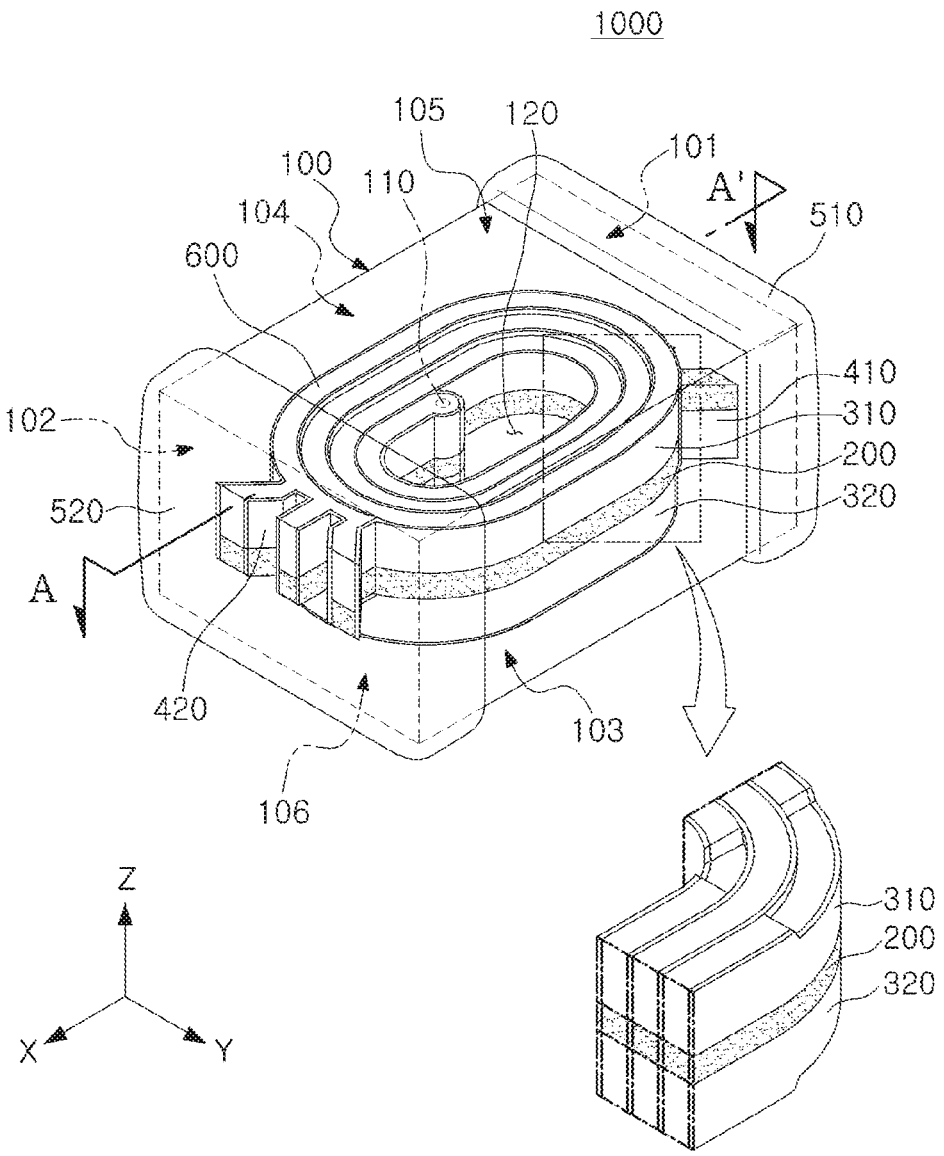
FIG. 1 is a perspective view schematically illustrating a coil component according to a first embodiment of the present disclosure.

The terms used in the description of the present disclosure are used to describe a specific embodiment, and are not intended to limit the present disclosure. A singular term may include a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include configurations in which another component is interposed between the elements such that the elements are also in contact with the other component.

Sizes and thicknesses of elements illustrated in the drawings are indicated as examples for ease of description, and the present disclosure is not limited thereto.

In the drawings, an X direction is a first direction or a length direction L, a Y direction is a second direction or a width direction W, and a Z direction is a third direction or a thickness direction T.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

FIRST EMBODIMENT

Figure 2:
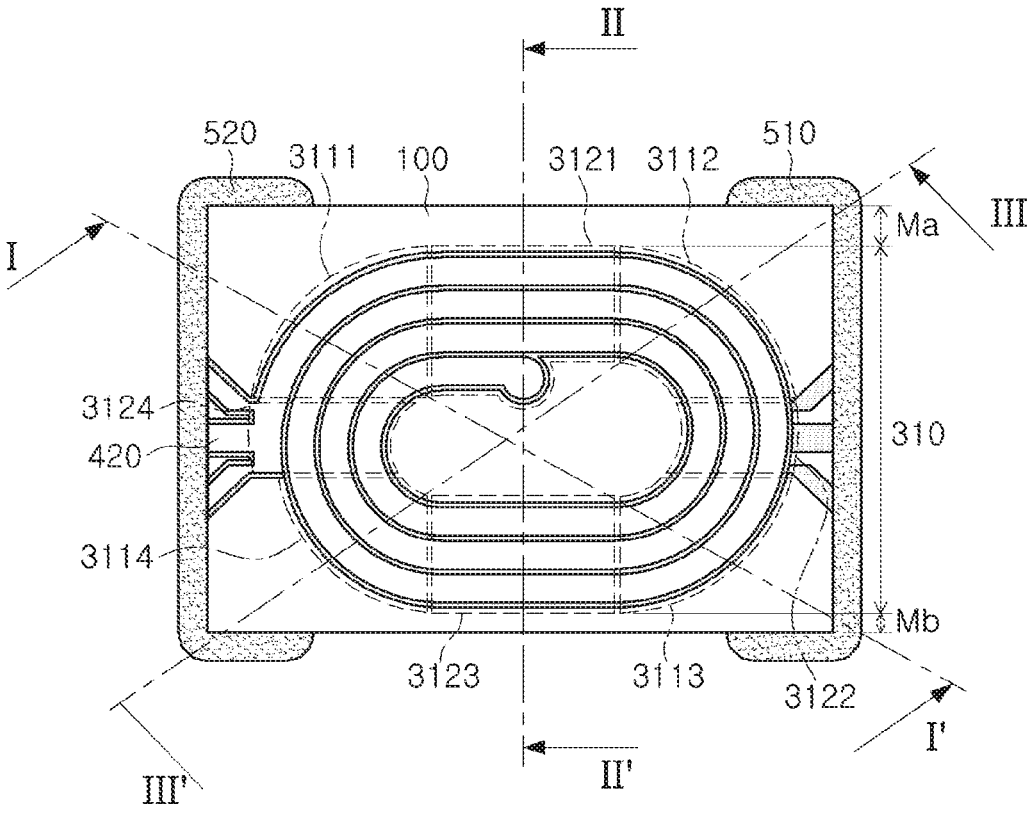
FIG. 2 is a schematic cross-sectional view taken along line A-A' of FIG. 1.
Figure 3:
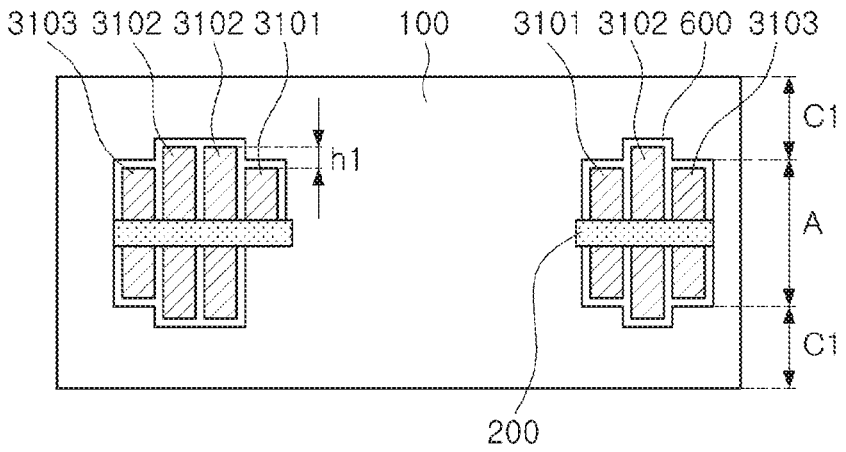
FIG. 3 is a schematic cross-sectional view taken along line I-I' of FIG. 2.
Figure 4:
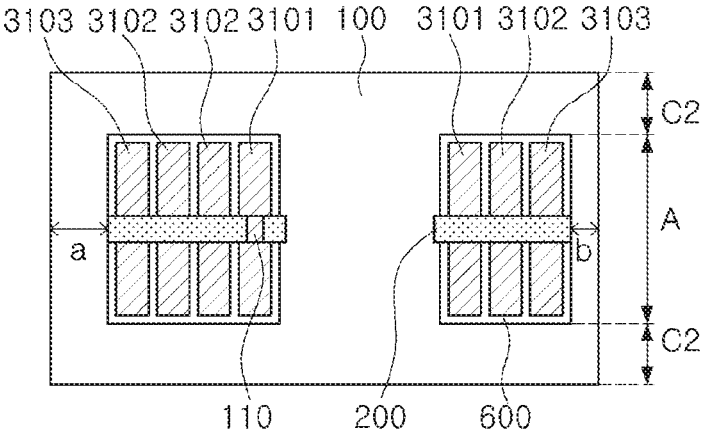
FIG. 4 is a schematic cross-sectional view taken along line II-II' of FIG. 2.
Figure 5:
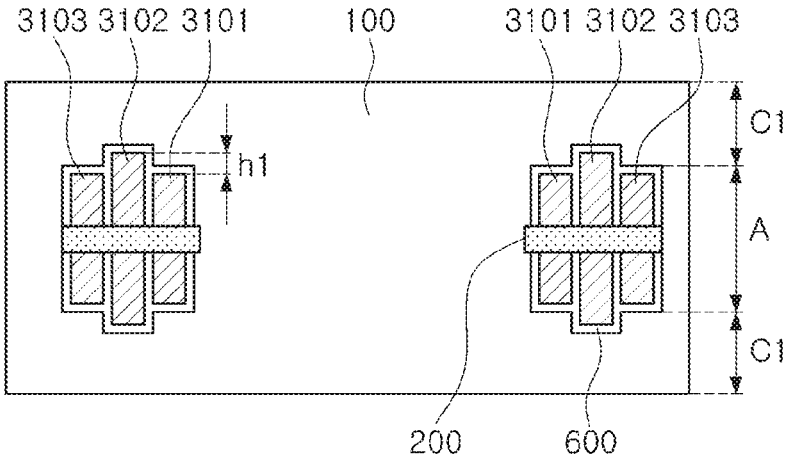
FIG. 5 is a schematic cross-sectional view taken along line III-III' of FIG. 2.

FIG. 1 is a perspective view schematically illustrating a coil component according to a first embodiment of the present disclosure. FIG. 2 is a schematic cross-sectional view taken along line A-A' of FIG. 1. FIG. 3 is a schematic cross-sectional view taken along line I-I' of FIG. 2. FIG. 4 is a schematic cross-sectional view taken along line II-II' of FIG. 2. FIG. 5 is a schematic cross-sectional view taken along line III-III' of FIG. 2.

Referring to FIGS. 1 to 5, a coil component 1000 according to the first embodiment of the present disclosure may include a body 100, a support substrate 200, coil portions 310 and 320, lead-out portions 410 and 420, and external electrodes 510 and 520.

The body 100 may form an exterior of the coil component 1000 according to this embodiment, and may embed the coil portions 310 and 320 therein.

The body 100 maybe formed to have a hexahedral shape overall.

Referring to FIGS. 1 and 2, the body 100 may include a first surface 101 and a second surface 102 opposing each other in a length direction X, a third surface 103 and a fourth surface 104 opposing each other in a width direction Y, and a fifth surface 105 and a sixth surface 106 opposing each other in a thickness direction Z. Hereinafter, one side surface and the other side surface of the body 100 may refer to the first surface 101 and the second surface 102 of the body, respectively, and one end surface and the other end surface of the body 100 may refer to the third surface 103 and the fourth surface 104 of the body, respectively. In addition, one surface and the other surface of the body 100 may refer to the sixth surface 106 and the fifth surface 105 of the body 100, respectively.

The body 100 may be formed such that the coil component 1000 according to this embodiment in which the external electrodes 510 and 520 to be described later are formed has a length of 1.0 mm, a width of 0.5 mm, and a thickness of 0.8 mm, but is not limited thereto. The above-mentioned numerical value may be only a numerical value for design that does not reflect the process error and the like, and other numeral values should be regarded as falling within the scope of the present disclosure to the extent that the process error is recognized.

The body 100 may include a core portion 120 penetrating coil portions 310 and 320 and the support substrate 200, which will be described later. The core portion 120 may be formed by filling a through-hole (not illustrated) of the coil portions 310 and 320 with a magnetic composite sheet, but is not limited thereto.

In this embodiment, the body 100 may include an active portion A in which coil portions 310 and 320 to be described later are disposed, and a cover portion C1 or C2 disposed on the active portion A. Referring to FIGS. 3 and 5, the active portion A may refer to a region in which an innermost turn 3101, among a plurality of turns of the coil portions 310 and 320, is disposed based on the thickness direction Z of the body 100. For example, the active portion A may correspond to a region in which a thickness of the support substrate 200 and thicknesses of innermost turns 3101 disposed on both surfaces of the support substrate 200 are added together. Referring to FIG. 4, the active portion A may refer to a region in which an intermediate turn 3102, among the plurality of turns of the coil portions 310 and 320, is disposed based on the thickness direction Z of the body 100. Referring to FIGS. 3 to 5, the cover portions C1 and C2 may refer to regions disposed above or below the active portion Abased on the thickness direction of the body 100.

Referring to FIGS. 2 to 5, the body 100 may include a first margin portion Ma and a second margin portion Mb, opposing each other in the width direction Y and disposed between an outer surface of the body 100 and the coil portions 310 and 320.

A larger number of turns of the coil portions 310 and 320 can provide the coil component with a larger saturation magnetization value. Further, to provide a magnetic path for magnetic flux produced by a relatively large number of turns on one side of the coil portions 310 and 320, a width or area of a magnetic body in the first margin portion Ma (adjacent to the relatively large number of coil turns) may be increased to form a magnetic flux density in total as uniform as possible relative to the magnetic flux density flowing through a second margin portion Mb (adjacent to a relatively smaller number of coil turns). Referring to FIG. 4, a distance (a) of the first margin portion Ma in the width direction Y may be longer than a distance (b) of the second margin portion Mb in the width direction Y. As a non-limiting example, the distance (a) of the first margin portion Ma in the width direction Y may be 1.2 times or more and 2 times or less of the distance (b) of the second margin portion Mb in the width direction Y. When the distance (a) is less than 1.2 times of the distance (b), a magnetic flux concentration phenomenon in a region having a relatively large number of turns may be not sufficiently solved. When the distance (a) is more than 2 times of the distance (b), an area occupied by a magnetic material in a region having a relatively large number of turns may be excessively enlarged and the magnetic flux density of the coil component in total may be unbalanced.

The first and second margin portions Ma and Mb may be formed during a design operation of the coil component, before dicing the coil component 1000 separately. For example, a position of a region corresponding to the core portion 120, e.g., a center portion, may be changed, to further increase the distance (a) of the region of the first margin portion Ma having a relatively large number of turns in the width direction Y. For example, in a coil having a larger number of turns on a first side of the core portion 120 than on a second side of the core portion 120 opposite to the first side, the first margin portion Ma on the first side of the core portion 120 may have a larger width (a) than the width (b) of the second margin portion Mb on the second side.

The body 100 may include a magnetic material and a resin. As a result, the body 100 may be magnetic. The body 100 may be formed by stacking at least one magnetic composite sheet including the resin and the magnetic material dispersed in the resin. The body 100 may have a structure other than the structure in which the magnetic material may be dispersed in the resin. For example, the body 100 may be made of a magnetic material such as ferrite.

The magnetic material may be, for example, a ferrite powder particle or a magnetic metal powder particle.

Examples of the ferrite powder particle may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The magnetic metal powder particle may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic material may be amorphous or crystalline. For example, the magnetic metal powder particle may be a Fe—Si—B—Cr-based amorphous alloy powder, but is not limited thereto.

The ferrite powder and the magnetic metal powder particle may have an average diameter of about 0.1 μm to 30 μm, respectively, but are not limited thereto.

The body 100 may include two or more types of magnetic materials dispersed in a resin. In this case, the term "different types of magnetic material" means that the magnetic materials dispersed in the resin are distinguished from each other by average diameter, composition, crystallinity, and a shape.

The resin may include an epoxy, a polyimide, a liquid crystal polymer, or the like, in a single form or in combined forms, but is not limited thereto.

The support substrate 200 may be embedded in the body 100 to support the coil portions 310 and 320 to be described later. The support substrate 200 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the support substrate 200 may be formed of an insulating material such as prepreg, Ajinomoto Build-up Film (ABF), FR-4, a bismaleimide triazine (BT) resin, a photoimageable dielectric (PID), a copper clad laminate (CCL), and the like, but is not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate 200 is formed of an insulating material including a reinforcing material, the support substrate 200 may provide better rigidity. When the support substrate 200 is formed of an insulating material not containing glass fibers, the support substrate 200 may be thicker and may thus reduce a thickness of the coil portions 310 and 320 in total, to reduce a thickness of the coil component 1000 according to this embodiment.

The coil portions 310 and 320 may be embedded in the body 100 and may be disposed on one surface and another opposite surface of the support substrate 200, to express characteristics of the coil component. For example, when the coil component 1000 of this embodiment is used as a power inductor, the coil portions 310 and 320 may function to stabilize the power supply of an electronic device by storing an electric field as a magnetic field and maintaining an output voltage.

In this embodiment, the coil portions 310 and 320 may include a first coil portion 310 and a second coil portion 320, disposed on respective opposing surfaces of the support substrate 200. The first coil portion 310 may be disposed on the one surface of the support substrate 200, to oppose the second coil portion 320 disposed on the other surface of the support substrate 200 opposing the one surface. The first and second coil portions 310 and 320 may be electrically connected to each other by a through-via 110 penetrating the support substrate 200. Each of the first coil portion 310 and the second coil portion 320 may have a planar spiral shape in which at least one turn is formed around the core portion 120. For example, the first coil portion 310 may form at least one turn about an axis of the core portion 120 on the one surface of the support substrate 200.

Referring to FIGS. 2 to 5, the coil portions 310 and 320 may each have a plurality of turns including an outermost turn 3103 adjacent to the outer surface of the body 100, an innermost turn 3101 adjacent to a central portion of the body 100, and one or more intermediate turn(s) 3102 disposed between the innermost turn 3101 and the outermost turn 3103. Referring to FIG. 2, each of the plurality of turns may include a plurality of corner portions 3111, 3112, 3113, and 3114 arranged to respectively face corners of the body 100 (e.g., each arranged adjacent to a respective corner of the body), and connection portions 3121, 3122, 3123, and 3124 for connecting adjacent corner portions 3111, 3112, 3113, and 3114, among the plurality of corner portions. In detail, the coil portions 310 and 320 may be partitioned into four corner portions 3111, 3112, 3113, and 3114 corresponding to and respectively facing (or adjacent to) corners of the body 100, and four connection portions 3121, 3122, 3123, and 3124 for connecting spaces between adjacent corner portions 3111, 3112, 3113, and 3114, among the plurality of corner portions. Referring to FIG. 2, as the coil portions 310 and 320 have a planar spiral shape, the coil portions 310 and 320 may be partitioned into first regions 3111, 3112, 3122, 3113, 3114, and 3124, and second regions 3121 and 3123 respectively having a curvature radius greater than a curvature radius of each of the first regions 3111, 3112, 3122, 3113, 3114 and 3124.

Referring to FIGS. 2 and 3, a difference in heights (h1) between the innermost turn 3101 and a turn 3102 adjacent to the innermost turn 3101, among the plurality of turns, may be greater in the corner portions 3111, 3112, 3113, and 3114 (e.g., as shown in FIGS. 3 and 5) than in the connection portions 3121, 3122, 3123, and 3124 (e.g., as shown in FIG. 4). Specifically, referring to FIGS. 3 and 5, a height of the intermediate turn 3102 in each of the corner portions 3111, 3112, 3113, and 3114 may be higher than a height of the innermost turn 3101 in each of the corner portions 3111, 3112, 3113, and 3114. Referring to FIGS. 2 and 4, in the connection portions 3121, 3122, 3123, and 3124, a height of the innermost turn 3101 may be equal to a height of an intermediate turn 3102 adjacent to the innermost turn 3101. Referring to FIGS. 1 and 2, the first regions 3111, 3112, 3122, 3113, 3114, and 3124 may be divided into regions 3111, 3112, 3113, and 3114 arranged to face the corners of the body 100, and regions 3122 and 3124 arranged adjacent to both side surfaces 101 and 102 of the body 100. In this case, the difference in heights (h1) between the innermost turn 3101 and a turn 3102 adjacent to the innermost turn 3101 may be particularly much larger in the regions 3111, 3112, 3113, and 3114 arranged to face the corners of the body 100, among the first regions 3111, 3112, 3122, 3113, 3114, and 3124.

As a result, referring to FIGS. 2 to 5, a thickness of a portion of the cover portion C1 of the body 100, disposed on the corner portions 3111, 3112, 3113, and 3114 may be thicker than a thickness of a portion of the cover portion C2 of the body 100, disposed on the connection portions 3121, 3122, 3123, and 3124. For example, a thickness of a portion corresponding to regions of the cover portions C1, e.g., 3111, 3112, 3113, and 3114, arranged to face the corners of the body 100, may be thicker than a thickness of a portion corresponding to regions, e.g., 3121, 3122, 3123, and 3124, excluding the regions arranged to face the corners of the body 100. For example, a thickness of the cover portion C1 illustrated in FIGS. 3 and 5 may be increased by the difference in heights (h1) between the innermost turn 3101 and the intermediate turn 3102, compared to a thickness of the cover portion C2 illustrated in FIG. 4.

Direct-current (DC) resistance (Rdc) characteristic, which may be one of the main characteristics of the coil component 1000, may be lowered as heights of the coil portions 310 and 320 increase. Further, inductance may increase, as an area of the magnetic body (e.g., an effective magnetic body area) in the body 100 through which the magnetic flux passes increases. Therefore, it is possible to lower the DC resistance Rdc and improve inductance by increasing the effective magnetic body area occupied by the magnetic material while increasing the heights of the coil portions 310 and 320.

In general, in the flow of magnetic flux generated from the coil portions 310 and 320, the magnetic flux concentration phenomenon is shown to occur particularly in the vicinity of the core portion 120 adjacent to the innermost turn 3101. The magnetic flux concentration phenomenon may be increased, as a size of the coil component 1000 is smaller and a thickness of the coil component 1000 is thinner.

As the coil portions 310 and 320 have a spiral shape, the magnetic body area through which magnetic flux passes may be relatively increased around the corners of the body 100. As a result, a difference in magnetic flux density between the core portion 120 of the body 100 and the corners of the body 100 may occurs, to be in an unbalanced flux flow in the coil component 1000 in total.

In this embodiment, the height of the innermost turn 3101, arranged to face the corners of the body 100, among the coil portions 310 and 320, may be lowered, to optimize the flux flow and improve inductance characteristics without increasing the size of the coil component 1000.

The lead-out portions 410 and 420 may be respectively connected to one end portion and the other end portion of the coil portions 320 and 310, and may be respectively exposed from the first and second surfaces 101 and 102 of the body 100. The lead-out portions 410 and 420 may include a first lead-out portion 410 disposed on the other surface of the support substrate 200, and a second lead-out portion 420 disposed on the one surface of the support substrate 200.

Referring to FIG. 1, an end portion of the first coil portion 310 formed on the one surface of the support substrate 200 may extend to form the second lead-out portion 420, and the second lead-out portion 420 may be exposed from the second surface 102 of the body 100. In addition, an end portion of the second coil portion 320 may extend to the other surface of the support substrate 200 opposing the one surface of the support substrate 200, to form the first lead-out portion 410, and the first lead-out portion 410 may be exposed from the first surface 101 of the body 100.

The lead-out portions 410 and 420 may include a plurality of connection conductors respectively disposed on the other surface and the one surface of the support substrate 200 to respectively connect the lead-out portions 410 and 420 and the coil portions 320 and 310. The plurality of connection conductors may be formed to be spaced apart from each other. As the body 100 is filled in an internal space between the connection conductors, spaced apart from each other, coupling force between the body 100 and the entire coil portion 310 and 320 may be further improved and inductance capacity may be improved.

The first coil portion 310 and the second lead-out portion 420 may be integrally formed such that no boundary is formed therebetween, but are only illustrative. Therefore, the above-described configurations are not excluded from the scope of the present disclosure in cases in which boundaries are formed in different stages. In this embodiment, the first coil portion 310 and the second lead-out portion 420 are described for convenience, but the same description may be applied to the second coil portion 320 and the first lead-out portion 410.

At least one of the first coil portion 310, the second lead-out portion 420, and the through-via 110 may include at least one conductive layer.

For example, when the first coil portion 310, the second lead-out portion 420, and the through-via 110 are formed on the one surface of the support substrate 200 by a plating process, each of the first coil portion 310, the second lead-out portion 420, and the through-via 110 may include a seed layer and an electroplating layer. The seed layer may be formed by an electroless plating process or by a vapor deposition process such as a sputtering process. The seed layer may be generally formed along a shape of the first coil portion 310. A thickness of the seed layer is not limited, but may be thinner than the electroplating layer. Next, the electroplating layer may be disposed on the seed layer. As a non-limiting example, the electroplating layer may be formed using an electroplating process. The seed layer and the electroplating layer may have a single layer structure or a multilayer structure. The electroplating layer of the multilayer structure may be formed in a conformal film structure in which one electroplating layer may be covered by the other electroplating layer, and may be only formed in a structure in which the other electroplating layer is stacked on one surface of any one electroplating layer.

The seed layer of the first coil portion 310 and the seed layer of the through-via 110 may be integrally formed so as not to form a boundary therebetween, but are not limited thereto.

The seed layer and the plating layer of each of the first coil portion 310, the second lead-out portion 420, and the through-via 110 may be formed of a conductive material such as copper (Cu), aluminum (Al), silver (Ag), tin (Sn), gold (Au), nickel (Ni), lead (Pb), titanium (Ti), molybdenum (Mo), or alloys thereof, but are not limited thereto.

Referring to FIGS. 2 to 5, an insulator 600 may be disposed between each of the coil portions 310 and 320 and the body 100. In this embodiment, since the body 100 includes a magnetic metal powder, the insulator 600 may be disposed between the coil portions 310 and 320 and the body 100 to insulate the coil portions 310 and 320.

As an example, in order to implement the coil portions 310 and 320 having a relatively high aspect ratio, the insulator 600 may be used as a plating growth guide, to adjust shapes of the coil portions 310 and 320 and to improve DC resistance characteristic Rdc.

After the above-described seed layer is attached to the support substrate 200, the insulator 600 may be disposed on the support substrate 200 to have a wall shape. Thereafter, the coil portions 310 and 320 having a plating layer may be formed by an electroplating process using the seed layer. The insulator 600 may be made of a resin including an epoxy-based resin, and one or more epoxy-based resins may be used.

As another example, but not limited to the above, the insulator 600 may be made of an insulating material that may be filled after the photosensitive resin is removed. Specifically, after the first coil portion 310 is formed, the photosensitive resin formed between the first coil portions 310 (e.g., between windings of the first coil portion 310) may be removed by a stripper, and the insulating material may be filled in a space from which the photosensitive resin between the first coil portions 310 has been removed. In addition, the first coil portion 310 may be surrounded with such an insulating material. Therefore, the insulating material covering the first coil portion 310 and the insulating material between windings of the first coil portion 310 may be integrally formed. The insulator 600 may be formed of, for example, a relatively thin parylene film, but the present disclosure is not limited thereto, and may also be formed by a spray coating process including a resin.

The external electrodes 510 and 520 may cover the lead-out portions 410 and 420, respectively. When the coil component 1000 according to this embodiment is mounted on a printed circuit board, the coil component 1000 may be electrically connected to the printed circuit board. For example, the coil component 1000 according to this embodiment may be mounted such that the sixth surface 106 of the body 100 faces an upper surface of the printed circuit board. Since the external electrodes 510 and 520 are mounted on or extend to the sixth surface 106 of the body 100 to be spaced apart from each other, a connection portion of the printed circuit board may be electrically connected.

The external electrodes 510 and 520 may include at least one of a conductive resin layer and an electroplating layer. The conductive resin layer may be formed by printing a conductive paste on a surface of the body 100 and curing the conductive paste. The conductive paste may include any one or more conductive metals selected from the group consisting of copper (Cu), nickel (Ni), and silver (Ag), and a thermosetting resin. The electroplating layer may include any one or more selected from the group consisting of nickel (Ni), copper (Cu), and tin (Sn). In this embodiment, each of the external electrodes 510 and 520 may include a first layer (not illustrated) formed on the surface of the body 100 to directly contact the lead-out portions 410 and 420, and a second layer (not illustrated) disposed on the first layer (not illustrated). For example, the first layer (not illustrated) may be a nickel (Ni) plating layer, and the second layer (not illustrated) may be a tin (Sn) plating layer, but are not limited thereto.

SECOND EMBODIMENT

Figure 6:
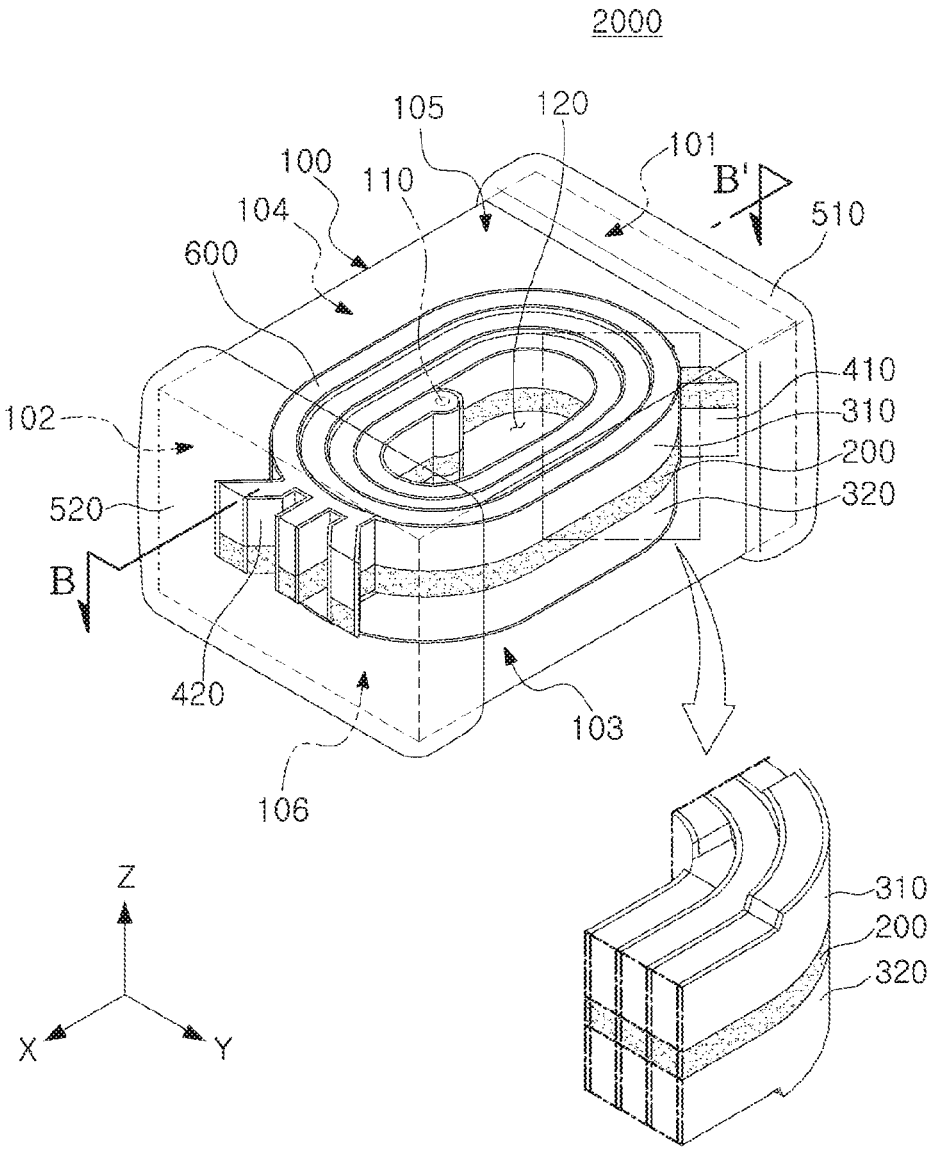
FIG. 6 is a perspective view schematically illustrating a coil component according to a second embodiment of the present disclosure.
Figure 7:
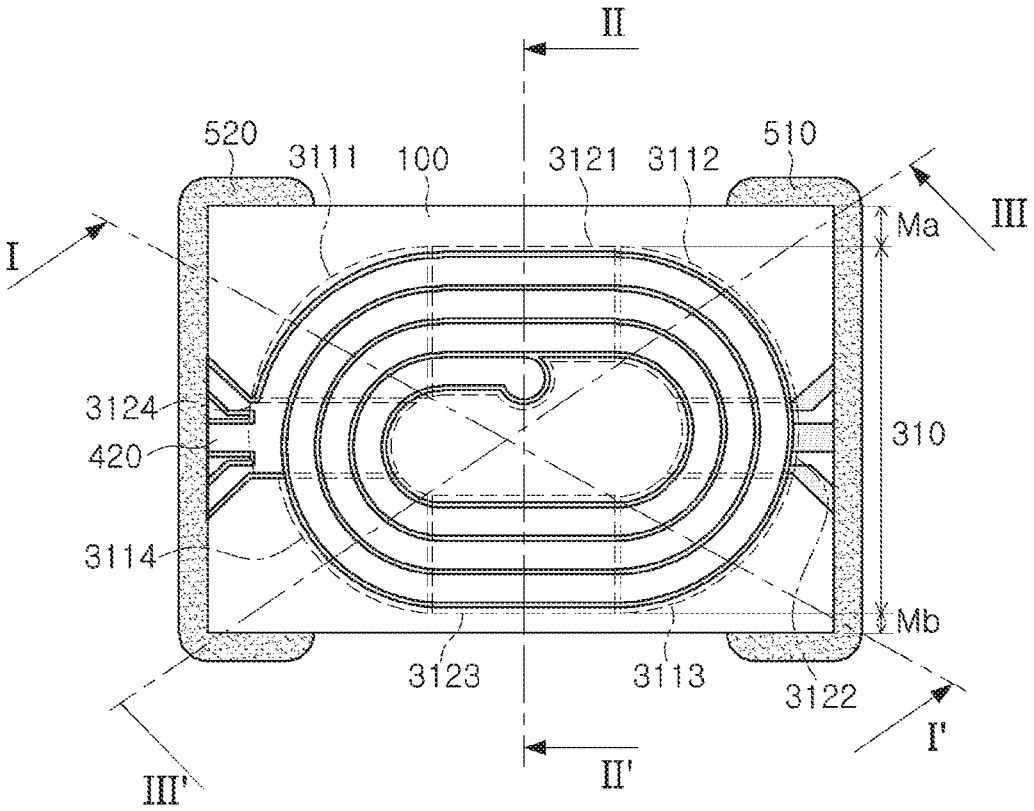
FIG. 7 is a schematic cross-sectional view taken along line B-B' of FIG. 6.
Figure 8:
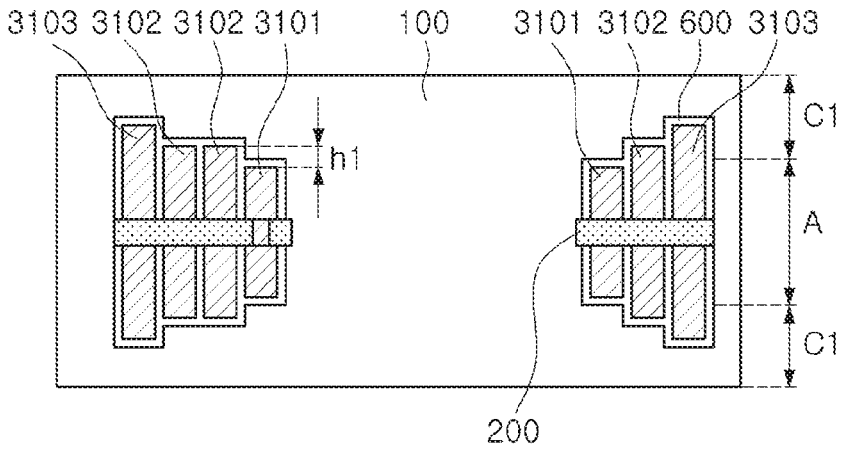
FIG. 8 is a schematic cross-sectional view taken along line I-I' of FIG. 7.
Figure 9:
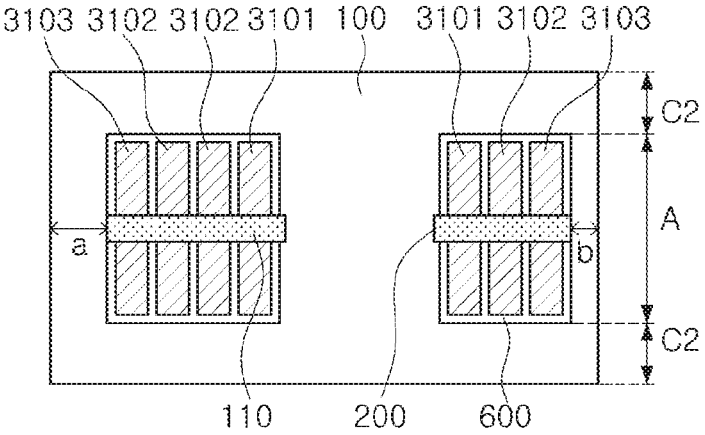
FIG. 9 is a schematic cross-sectional view taken along line II-II' of FIG. 7.
Figure 10:
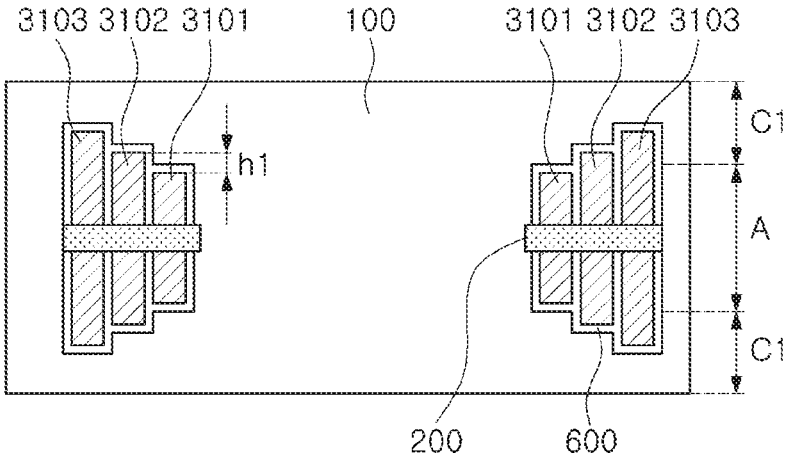
FIG. 10 is a schematic cross-sectional view taken along line III-III' of FIG. 7.

FIG. 6 is a perspective view schematically illustrating a coil component according to a second embodiment of the present disclosure. FIG. 7 is a schematic cross-sectional view taken along line B-B' of FIG. 6. FIG. 8 is a schematic cross-sectional view taken along line I-I' of FIG. 7. FIG. 9 is a schematic cross-sectional view taken along line II-II' of FIG. 7. FIG. 10 is a schematic cross-sectional view taken along line III-III' of FIG. 7.

When FIGS. 1 and 6, FIGS. 2 and 7, FIGS. 3, and 8, FIGS. 4 and 9, and FIGS. 5 and 10, respectively, are compared, e.g., when the coil component 1000 according to the first embodiment is compared with a coil component 2000 according to this embodiment, heights of corner portions 3111, 3112, 3113, and 3114 of an outermost turn 3103 are different from each other. Therefore, only the heights of the corner portions 3111, 3112, 3113, and 3114 of the outermost turn 3103, which may be different from the first embodiment of the present disclosure, will be described in relation to this embodiment. The remaining configuration of this embodiment may be applied as it is in the first embodiment of the present disclosure.

Referring to FIGS. 8 and 10, a height of each of the corner portions 3111, 3112, 3113, and 3114 of the outermost turn 3103 may be higher than a height of each of the corner portions 3111, 3112, 3113, and 3114 of an intermediate turn 3102. As described above, magnetic flux concentration phenomenon may be generated in a relatively large amount, as it is closer to an innermost turn 3101. In this embodiment, the innermost turn 3101, the intermediate turn 3102, and the outermost turn 3103 may be formed in order to have increasing heights to increase the magnetic flux area through which the coil portions 310 and 320 pass. Therefore, the magnetic flux concentration phenomenon may be alleviated.

Furthermore, the coil portions 310 and 320 having heights that sequentially increase from the innermost turn 3101 toward the middle turn 3102 and the outermost turn 3103 may be arranged only at the corner portions 3111, 3112, 3113, and 3114. As a result, the magnetic flux density deviation between a peripheral area of the core portion 120 and the corners of the body 100 may be alleviated more.

The present disclosure is not limited by the above-described embodiment and the accompanying drawings. Therefore, various forms of substitution, modification, and alteration may be made by those skilled in the art without departing from the technical spirit of the present disclosure described in the claims, which may be also within the scope of the present disclosure.

The expression "an embodiment" used in the present disclosure does not mean the same embodiment, but may be provided to emphasize different unique features, respectively. However, the descriptions of above embodiments do not exclude implementations including combinations of the features between the various examples. For example, even though the matter described in one specific embodiment may be not described in another embodiment, it can be understood as a description related to another embodiment, unless there is a description that is contradictory to those in the other embodiment.

Meanwhile, the terminology used herein is for the purpose of describing an embodiment only and may be not intended to be limiting of the present disclosure. As used herein, the singular forms "a", "an," and "the" include plural forms unless the context clearly indicates otherwise.

According to the present disclosure, a coil component capable of mitigating magnetic flux concentration and improving inductance characteristics in the same volume may be provided.

While example embodiments have been illustrated and described above, it will be apparent to those skilled in the art that modifications and variations could be made without departing from the scope of the present disclosure as defined by the appended claims.

What is claimed is:

1. A coil component comprising:

a body; and a coil portion embedded in the body and having a plurality of turns wound about an axis, wherein each of the plurality of turns includes a plurality of corner portions adjacent to all corners of the body, and at least one connection portion connecting adjacent corner portions among the plurality of corner portions, and a difference in heights, measured in a direction of the axis, between an innermost turn and a turn adjacent to the innermost turn, among the plurality of turns, is greater in each of the plurality of corner portions than in the connection portion.

2. The coil component according to claim 1, wherein the plurality of turns comprise an outermost turn adjacent to an outer surface of the body, and an intermediate turn disposed between the innermost turn and the outermost turn, and a height of each of the plurality of corner portions in the intermediate turn is higher than a height of each of the plurality of corner portions in the innermost turn.

3. The coil component according to claim 2, wherein a height of each of the plurality of corner portions in the outermost turn is higher than a height of each of the plurality of corner portions in the intermediate turn.

4. The coil component according to claim 1, wherein a height of the connection portion in the innermost turn is equal to a height of the connection portion in a turn adjacent to the innermost turn.

5. The coil component according to claim 1, wherein the body comprises an active portion in which the coil portion is disposed, and a cover portion disposed above the active portion in the direction of the axis, and a thickness, measured in the direction of the axis, of a portion of the cover portion disposed above each of the plurality of corner portions is greater than a thickness, measured in the direction of the axis, of a portion of the cover portion disposed above the connection portion.

6. The coil component according to claim 1, wherein the body comprises two outer surfaces opposing each other in a width direction orthogonal to the axis, and a first margin portion and a second margin portion disposed opposite each other in the width direction and each disposed between a corresponding one of the outer surface and the coil portion, a number of turns of the coil portion between a center of the coil portion and the first margin portion is greater than a number of turns of the coil portion between the center of the coil portion and the second margin portion, and a width of the first margin portion in the width direction is greater than a width of the second margin portion in the width direction.

7. The coil component according to claim 6, wherein the width of the first margin portion in the width direction is 1.2 times or more and 2 times or less of the width of the second margin portion in the width direction.

8. The coil component according to claim 1, wherein the body further comprises one side surface and another side surface, opposing each other in a length direction orthogonal to the axis, and the coil component comprises lead-out portions each connected to a respective end portion of the coil portion and exposed from a respective side surface of the one side surface and the other side surface of the body.

9. The coil component according to claim 8, further comprising:

external electrodes each covering a respective lead-out portion of the lead-out portions.

10. A coil component comprising:

a support substrate;

a body embedding the support substrate; and a coil portion disposed on the support substrate and having a plurality of turns, wherein the coil portion has a first region, and a second region having a curvature radius greater than a curvature radius of the first region, the coil portion includes a step portion between the first region and the second region and a difference in heights between an innermost turn and a turn adjacent to the innermost turn, among the plurality of turns, is greater in the first region than in the second region.

11. The coil component according to claim 10, wherein the body comprises a first margin portion and a second margin portion, opposite each other in a width direction and each disposed between the coil portion and a respective outer surface among outer surfaces of the body opposing each other in the width direction, a number of turns of the coil portion between a center of the coil portion and the first margin portion is greater than a number of turns of the coil portion between the center of the coil portion and the second margin portion, and a width of the first margin portion in the width direction is longer than a width of the second margin portion in the width direction.

12. The coil component according to claim 10, wherein the plurality of turns comprises an outermost turn adjacent to an outer surface of the body, and an intermediate turn disposed between the innermost turn and the outermost turn, and a height of the first region in the intermediate turn is higher than a height of the first region in the innermost turn.

13. The coil component according to claim 12, wherein a height of the first region in the outermost turn is higher than the height of the first region in the intermediate turn.

14. The coil component according to claim 12, wherein a height of the second region in the innermost turn is equal to a height of the second region in the turn adjacent to the innermost turn.

15. The coil component according to claim 10, wherein the body comprises an active portion in which the support substrate and the coil portion are arranged, and a cover portion disposed on the active portion, and a thickness of a portion of the cover portion disposed on the first region is greater than a thickness of a portion of the cover portion disposed on the second region.

16. A coil component comprising:

a body; and a coil portion embedded in the body and having a plurality of turns wound about an axis extending through a center of the coil, wherein the body includes a first margin disposed between the coil portion and a first outer surface of the body, and a second margin disposed between the coil portion and a second outer surface of the body opposing the first outer surface in a width direction orthogonal to the axis, a number of turns of the coil portion between the center of the coil portion and the first margin portion is greater than a number of turns of the coil portion between the center of the coil portion and the second margin portion, and a width of the first margin portion in the width direction is greater than a width of the second margin portion in the width direction.

17. The coil component according to claim 16, wherein the width of the first margin portion is 1.2 times or more and 2 times or less of the width of the second margin portion.

18. A coil component comprising:

a body; and a coil portion embedded in the body and having a plurality of turns wound about an axis, wherein each of the plurality of turns includes a plurality of corner portions adjacent to all corners of the body, and at least one connection portion connecting adjacent corner portions among the plurality of corner portions, and a height, measured in a direction of the axis, of a turn among the plurality of turns is lower in each of the plurality of corner portions than in the connection portion.

19. The coil component according to claim 18, wherein a height, measured in the direction of the axis, of another turn among the plurality of turns is even in each of the plurality of corner portions and in the connection portion.

20. The coil component according to claim 18, wherein a height, measured in the direction of the axis, of another turn among the plurality of turns is higher in each of the plurality of corner portions than in the connection portion.

21. The coil component according to claim 20, the turn having the height lower in each of the plurality of corner portions than in the connection portion is an innermost turn among the plurality of turns, and the other turn having the height higher in each of the plurality of corner portions than in the connection portion is an outermost turn among the plurality of turns.

22. The coil component according to claim 20, wherein the turn having the height lower in each of the plurality of corner portions than in the connection portion, and the other turn having the height higher in each of the plurality of corner portions than in the connection portion, have a same height as each other in the connection portion.

* * * * *